US009019359B2

(12) United States Patent
Leedy et al.

(10) Patent No.: US 9,019,359 B2
(45) Date of Patent: Apr. 28, 2015

(54) FOOT IMAGING AND MEASUREMENT APPARATUS

(75) Inventors: Gregory R. Leedy, Milwaukie, OR (US); Natalie A. Candrian, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 519 days.

(21) Appl. No.: 13/433,463

(22) Filed: Mar. 29, 2012

(65) Prior Publication Data

US 2013/0258085 A1 Oct. 3, 2013

(51) Int. Cl.
*H04N 7/18* (2006.01)
*A43D 1/02* (2006.01)

(52) U.S. Cl.
CPC . *A43D 1/02* (2013.01); *A43D 1/025* (2013.01)

(58) Field of Classification Search
CPC ..... A43D 1/025; A43D 1/02; A43D 1/022; A43D 3/021; A43D 3/027; A43D 999/00
See application file for complete search history.

(56) References Cited

U.S. PATENT DOCUMENTS

| | | | | |
|---|---|---|---|---|
| 2,136,832 | A | | 11/1938 | Weisberger |
| 2,480,361 | A | | 8/1949 | Doumitt |
| 3,066,417 | A | | 12/1962 | Samuels |
| 3,173,746 | A | | 3/1965 | Rockmore |
| 3,192,627 | A | | 7/1965 | Levitt et al. |
| 3,328,882 | A | | 7/1967 | Blivice |
| 3,457,647 | A | | 7/1969 | Cohen et al. |
| 4,267,728 | A | | 5/1981 | Manley et al. |
| 4,294,014 | A | | 10/1981 | Baumann et al. |
| 4,534,365 | A | | 8/1985 | Bonetta et al. |
| 4,538,353 | A | | 9/1985 | Gardner |
| 4,604,807 | A | | 8/1986 | Bock et al. |
| 5,025,476 | A | * | 6/1991 | Gould et al. ..... 382/115 |
| 5,128,880 | A | | 7/1992 | White |
| 5,164,793 | A | | 11/1992 | Wolfersberger et al. |
| 5,195,030 | A | | 3/1993 | White |
| 5,237,520 | A | | 8/1993 | White |
| 5,361,133 | A | * | 11/1994 | Brown et al. ..... 356/612 |
| 5,539,677 | A | | 7/1996 | Smith |
| 5,671,055 | A | | 9/1997 | Whittlesey et al. |
| 5,689,446 | A | | 11/1997 | Sundman et al. |
| 6,029,358 | A | | 2/2000 | Mathiasmeier et al. |
| 6,163,971 | A | | 12/2000 | Humphries, Jr. et al. |

(Continued)

FOREIGN PATENT DOCUMENTS

| | | |
|---|---|---|
| EP | 0014022 | 8/1980 |
| EP | 1051925 | 11/2000 |

(Continued)

*Primary Examiner* — Huy T Nguyen
(74) *Attorney, Agent, or Firm* — Plumsea Law Group, LLC

(57) ABSTRACT

An apparatus for obtaining an image and measurements of a foot is disclosed. The apparatus includes a housing holding a plate with a top surface to allow a user to stand on the apparatus. Within the interior of the housing is a compact mirror assembly arrangement that includes a plurality of mirrors to reflect the image of the foot from the top surface of the plate to at least one camera within the interior of the housing. The compact mirror assembly includes a top-facing mirror running along the longitudinal direction of the housing at an angle to the bottom surface. The top-facing mirror reflects the image of the foot from the top surface towards an angled mirror. The angled mirror is perpendicular to the bottom surface and is angled facing the top-facing mirror. The angled mirror reflects the image of the foot reflected from the top-facing mirror towards the camera.

20 Claims, 10 Drawing Sheets

(56) References Cited

U.S. PATENT DOCUMENTS

| | | | | |
|---|---|---|---|---|
| 6,205,230 | B1 | 3/2001 | Sundman et al. | |
| 6,289,107 | B1 * | 9/2001 | Borchers et al. | 382/100 |
| 6,331,893 | B1 | 12/2001 | Brown et al. | |
| 6,549,639 | B1 | 4/2003 | Genest | |
| 6,550,149 | B2 | 4/2003 | Dowdell | |
| 6,654,705 | B1 | 11/2003 | Benson et al. | |
| 6,847,915 | B2 | 1/2005 | Liang et al. | |
| 6,879,945 | B1 | 4/2005 | Cook | |
| 7,051,452 | B2 | 5/2006 | Brooks | |
| 7,089,152 | B2 | 8/2006 | Oda et al. | |
| 7,114,260 | B2 | 10/2006 | Nguyen et al. | |
| 7,287,293 | B2 | 10/2007 | Cook et al. | |
| 7,336,377 | B2 | 2/2008 | Danenberg et al. | |
| 7,409,256 | B2 | 8/2008 | Lin et al. | |
| 7,552,494 | B2 | 6/2009 | Peterson | |
| 7,738,145 | B2 | 6/2010 | Pishdadian et al. | |
| 7,742,633 | B2 | 6/2010 | Huang et al. | |
| 7,757,325 | B2 | 7/2010 | Cook et al. | |
| 7,952,727 | B2 * | 5/2011 | Sundman et al. | 356/601 |
| 7,980,007 | B2 | 7/2011 | Cook et al. | |
| 7,992,243 | B2 | 8/2011 | Cook et al. | |
| 2004/0081336 | A1 | 4/2004 | Brooks | |
| 2005/0071242 | A1 | 3/2005 | Allen et al. | |
| 2005/0097762 | A1 | 5/2005 | Biesbrouck et al. | |
| 2009/0247909 | A1 | 10/2009 | Mukumoto | |

FOREIGN PATENT DOCUMENTS

| | | |
|---|---|---|
| JP | 08166219 | 6/1996 |
| JP | 08242908 | 9/1996 |
| JP | 2000296005 | 10/2000 |
| JP | 2001227917 | 8/2001 |
| JP | 2002081912 | 3/2002 |
| JP | 2002291502 | 10/2002 |
| JP | 2004219404 | 8/2004 |
| JP | 3854599 | 12/2006 |
| WO | 2004075677 | 9/2004 |
| WO | 2008006937 | 1/2008 |
| WO | 2008057056 | 5/2008 |

* cited by examiner

FOOT IMAGING AND MEASUREMENT APPARATUS

BACKGROUND

The present invention relates generally to an apparatus for imaging and measuring a foot, and, in particular, to a compact mirror assembly arrangement for use in a foot imaging and measurement apparatus.

Various types of mechanical and electrical devices for measuring a foot have been previously proposed to assist with selecting an appropriate size or style of shoe for a wearer or to provide shoes with dimensions customized to the foot measurements of a wearer. Mechanical devices may be difficult to use correctly. Electrical devices may be cumbersome and not easily moved to accommodate use by multiple persons. The athletic shoe industry continues to research ways to improve the fit of athletic shoes, and to customize the fit to an individual wearer.

Therefore, there exists a need in the art for a foot imaging and measurement apparatus that is easy to use and is readily transportable.

SUMMARY

In one aspect, the invention provides a foot imaging and measurement apparatus comprising: a plate having a top surface, the top surface configured to receive at least one foot of a user; a housing, the housing configured to receive the plate; a compact mirror assembly disposed within an interior of the housing, the compact mirror assembly including: a first mirror disposed along a longitudinal direction of the housing, the first mirror oriented at a first angle from a bottom surface of the housing such that the first mirror is facing towards the plate; a second mirror disposed along a lateral direction of the housing, the second mirror being substantially perpendicular to the bottom surface of the housing and oriented at a second angle from a rear panel of the housing such that the second mirror is facing towards the first mirror; and a camera disposed within the interior of the housing adjacent to a front panel of the housing, wherein the camera is facing towards the second mirror.

In another aspect, the invention provides a foot imaging and measurement apparatus comprising: a plate having a top surface, the top surface configured to receive at least one foot of a user; a housing having a rectangular shape, the housing comprising a front panel, a rear panel, a first side panel, a second side panel, and a bottom surface, the housing further configured to receive the plate at a top end; the housing including a interior disposed below the plate; a divider disposed along a longitudinal direction of the housing, the divider separating the interior into a second side and a first side; a first compact mirror assembly disposed within the first side of the interior of the housing, the first compact mirror assembly including: a first mirror disposed along the longitudinal direction of the housing, the first mirror oriented at a first angle from the bottom surface of the housing such that the first mirror is facing towards the plate; a second mirror disposed along a lateral direction of the housing, the second mirror being substantially perpendicular to the bottom surface of the housing and oriented at a second angle from the rear panel of the housing such that the second mirror is facing towards the first mirror; and a first camera disposed within the first side of the interior of the housing adjacent to the front panel, wherein the first camera is facing towards the second mirror.

In another aspect, the invention provides a foot imaging and measurement apparatus, the foot imaging and measurement apparatus comprising: a housing, the housing comprising a front panel, a first side panel, a second side panel, a rear panel, and a bottom surface; a plate, the plate disposed on a top end of the housing opposite the bottom surface of the housing; the housing including an interior, the interior having a generally rectangular shape defined by the front panel, the first side panel, the second side panel, and the rear panel; a camera disposed within the interior of the housing; a compact mirror assembly disposed within the interior of the housing, the compact mirror assembly comprising: a first mirror disposed along a longitudinal direction of the interior, adjacent to at least one of the first side panel and the second side panel, the first mirror disposed at approximately a 45 degree angle from the bottom surface such that a top end of the first mirror is adjacent to the plate and a bottom end is proximate the bottom surface; a second mirror disposed along a lateral direction of the interior, adjacent to the rear panel and disposed generally perpendicular to the bottom surface, the second mirror disposed at approximately a 45 degree angle from the rear panel in a direction towards the first mirror; and wherein the first mirror, the second mirror, and the camera are disposed along the same horizontal plane within the interior of the housing.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
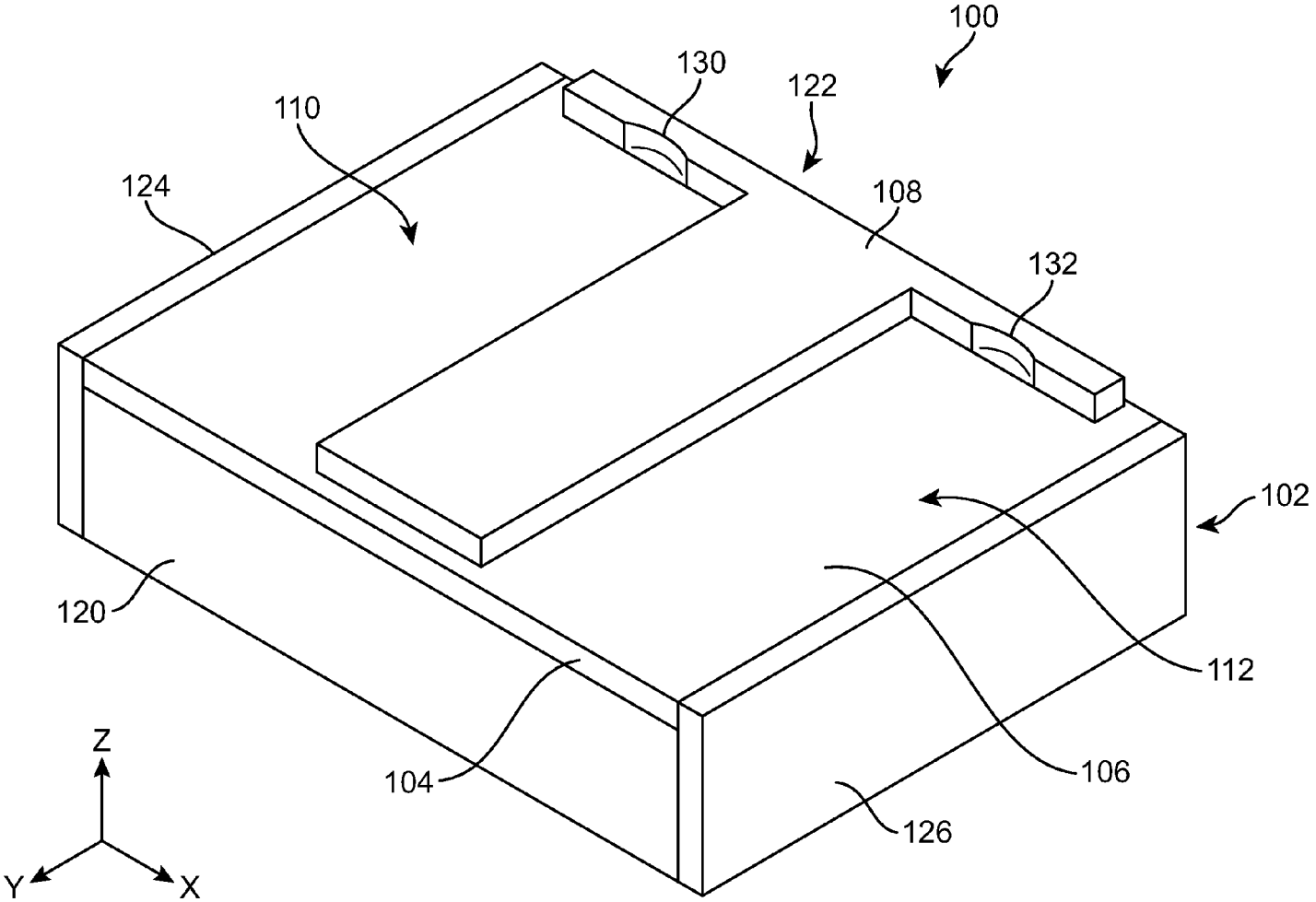
FIG. 1 is an isometric view of an exemplary embodiment of a foot imaging and measurement apparatus.

An exemplary embodiment of a foot imaging and measurement apparatus 100, also called a "foot photo device," is shown in the Figures. FIG. 1 is an isometric view of foot imaging and measurement apparatus 100. In some embodiments, foot imaging and measurement apparatus 100 may be configured to obtain images and/or measurements of a single foot or both feet of a user.

For consistency and convenience, directional adjectives are employed throughout this detailed description corresponding to one or more axes associated with the illustrated foot imaging and measurement apparatus 100. The term "longitudinal" as used throughout this detailed description and in the claims refers to a direction extending a length of foot imaging and measurement apparatus 100 along the y-axis. Also, the term "lateral" as used throughout this detailed description and in the claims refers to a direction extending a width of foot imaging and measurement apparatus 100 along the x-axis. Furthermore, the term "vertical" as used throughout this detailed description and in the claims refers to a direction along the z-axis that is generally perpendicular to the lateral and longitudinal direction. For example, in cases where foot imaging and measurement apparatus 100 is disposed flat on a ground surface, the vertical direction may extend from the ground surface upward. It will be understood that each of these directional adjectives may be applied to individual components of foot imaging and measurement apparatus 100.

In some embodiments, foot imaging and measurement apparatus 100 may include a housing 102. Housing 102 may accommodate the various components of foot imaging and measurement apparatus 100. Housing 102 may be made of any material. In an exemplary embodiment, housing 102 may be made of any one or combination of metal, plastic, wood, as well as any other materials suitable for constructing a housing. In an exemplary embodiment, housing 102 may be configured with a generally rectangular shape. In other embodiments, however, housing 102 may be other shapes.

In this embodiment, housing 102 may include one or more panels disposed on different portions of housing 102. In some embodiments, housing 102 may include a front panel 120. Front panel 120 may be disposed at a front end of foot imaging and measurement apparatus 100 facing away from a user. Similarly, housing 102 may also include a rear panel 122 disposed opposite of front panel 120 at a back end of foot imaging and measurement apparatus 100 facing towards a user. In addition, housing 102 may further include side panels disposed on either side of housing 102, including a first side panel 124 associated with one side of housing 102 and a second side panel 126 associated with a second side of housing 102. Taken together, front panel 120, rear panel 122, first side panel 124, and second side panel 126 may be joined together to form the generally rectangular shape of housing 102.

In some embodiments, housing 102 may serve as a base for holding and supporting a plate 104 in place on a top side of foot imaging and measurement apparatus 100. Plate 104 provides a top surface 106 that is configured for a user to stand on with one or both feet to obtain images and/or measurements of the user's foot or feet. With this arrangement, a user may stand on foot imaging and measurement apparatus 100 with his or her feet on top surface 106 of plate 104.

In an exemplary embodiment, plate 104 may be made of a generally transparent material. Some materials that may be used to make plate 104 include acrylic, polycarbonate, glass, as well as other transparent or semi-transparent materials. With this arrangement, cameras or other sensors within the interior of housing 102 may be able to obtain images from outside of foot imaging and measurement apparatus 100. For example, images of a foot or feet of a user can pass light through the transparent or semi-transparent plate 104 to the cameras or sensors disposed within the interior of housing 102. In addition, the materials used to make plate 104 may be sufficiently strong so as to be capable of withstanding the weight from a user standing on top surface 106 of plate 104. In other embodiments, one or more films or other treatments may be provided to plate 104 to add strength and/or to resist shattering.

In some embodiments, foot imaging and measurement apparatus 100 may include a foot guide 108. Foot guide 108 may be disposed on top surface 106 of plate 104 and may assist a user with placement of the user's foot or feet onto top surface 106 of foot imaging and measurement apparatus 100. In some cases, foot guide 108 may be fixedly attached to top surface 106 and plate 104. In other cases, foot guide 108 may be removably secured to top surface 106. In this embodiment, foot guide 108 divides top surface 106 of plate 104 into a first portion 110 and a second portion 112. In an exemplary embodiment, a right foot of a user will be disposed on first portion 110 of top surface 106 and a left foot of a user will be disposed on second portion 112 of top surface 106 on either side of foot guide 108 when a user is standing on top of foot imaging and measurement apparatus 100.

In some embodiments, foot guide 108 may include features configured to assist a user with placement of his or her feet on foot imaging and measurement apparatus 100. In an exemplary embodiment, foot guide 108 includes a first recess 130 in foot guide 108 on first portion 110 and a second recess 132 in foot guide 108 disposed on second portion 112. First recess 130 and/or second recess 132 may be configured as shallow concave divots or contoured portions of foot guide 108 that are shaped to correspond to a heel of a user's foot when placed against foot guide 108. In some embodiments, first recess 130 and/or second recess 132 may be located on a portion of foot guide 108 above top surface 106 of plate 104. For example, when a user stands on top surface 106 of plate 104, the heel of his or her right foot may be configured to associate with first recess 130. Similarly, the heel of the user's left foot may be configured to associate with second recess 132. With this arrangement, first recess 130 and second recess 132 may assist a user with the proper alignment of his or her feet on foot imaging and measurement apparatus 100. In other embodiments, first recess 130 and/or second recess 132 are optional and may be omitted.

Figure 2:
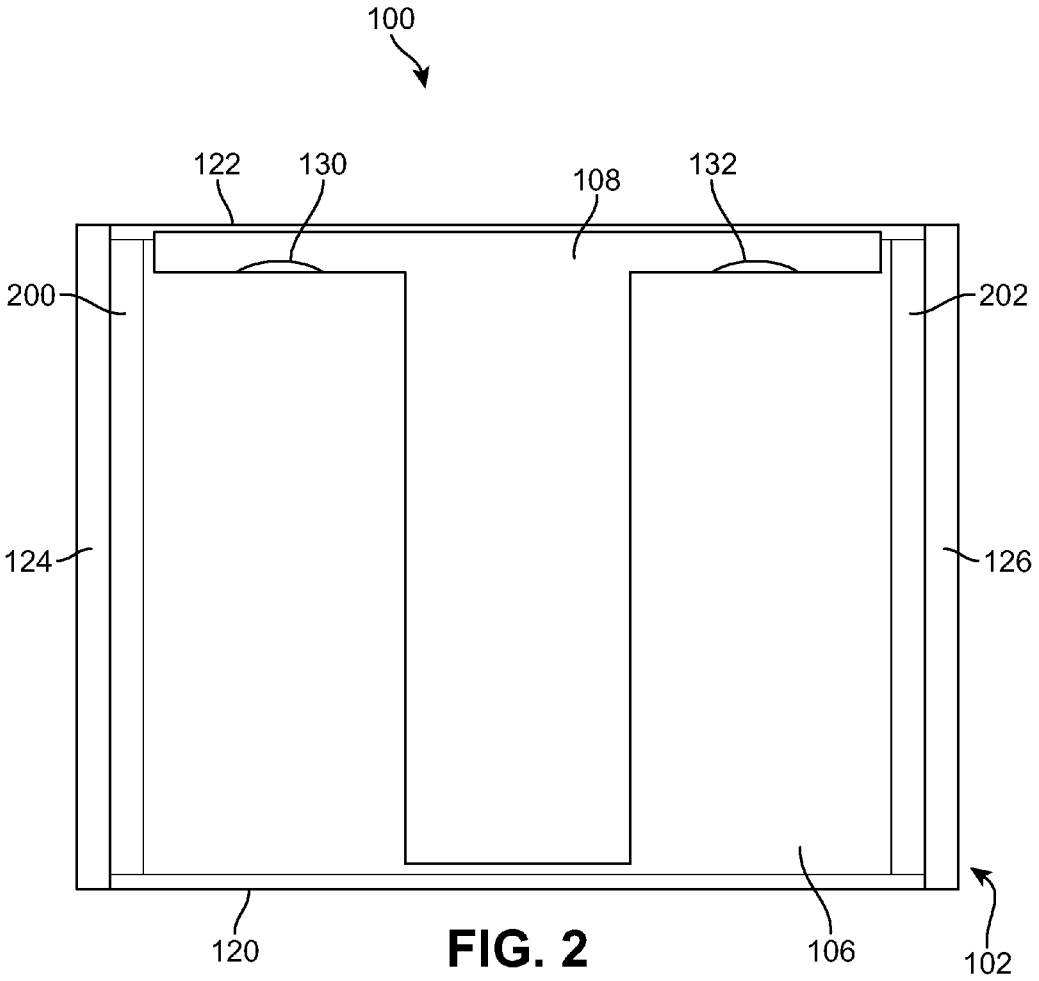
FIG. 2 is a top view of an exemplary embodiment of a foot imaging and measurement apparatus.

Referring now to FIG. 2, a top view of foot imaging and measurement apparatus 100 is illustrated. In some embodiments, plate 104 may be configured to sit within housing 102 so that top surface 106 is flush with the top of first side panel 124 and second side panel 126. In an exemplary embodiment, housing 102 may include one or more support structures within housing 102 that are configured to provide support underneath plate 104. In one embodiment, housing 102 may include ledges on the first and second sides to provide support underneath plate 104.

In this embodiment, housing 102 includes a first side ledge 200 disposed along the first side of housing 102 adjacent to first side panel 124. In some embodiments, first side ledge 200 may be attached to first side panel 124. In other embodiments, first side ledge 200 may be integrally formed with first side panel 124 as a notch or cut-out portion. Similarly, housing 102 also includes a second side ledge 202 disposed along the second side of housing 102 adjacent to second side panel 126. As with first side ledge 200, in some embodiments, second side ledge 202 may be attached to second side panel 126, and in other embodiments, second side ledge 202 may be integrally formed with second side panel 126 as a notch or cut-out portion.

In an exemplary embodiment, each of first side ledge 200 and second side ledge 202 may be disposed at a depth below the top of first side panel 124 and second side panel 126, respectively, that corresponds to the thickness of plate 104. With this arrangement, first side ledge 200 and second side ledge 202 may be configured to hold plate 104 within housing 102 so that top surface 106 of plate 104 is flush with the top of first side panel 124 and second side panel 126. In other embodiments, first side ledge 200 and/or second side ledge 202 may be disposed at higher or lower depths below the top of the side panels so that top surface 106 of plate 104 sits above or below the top of first side panel 124 and second side panel 126.

In exemplary embodiment, foot imaging and measurement apparatus 100 is configured so that a user stands on top surface 106 of foot imaging and measurement apparatus 100 to obtain images and/or measurements of one or both feet from below. In one embodiment, first side ledge 200 and second side ledge 202 are configured to provide structural support to plate 104 when a user stands on top surface 106. In other embodiments, additional support structures may be provided within housing 102 to provide sufficient support to allow a user to stand on top of foot imaging and measurement apparatus 100.

Figure 3:
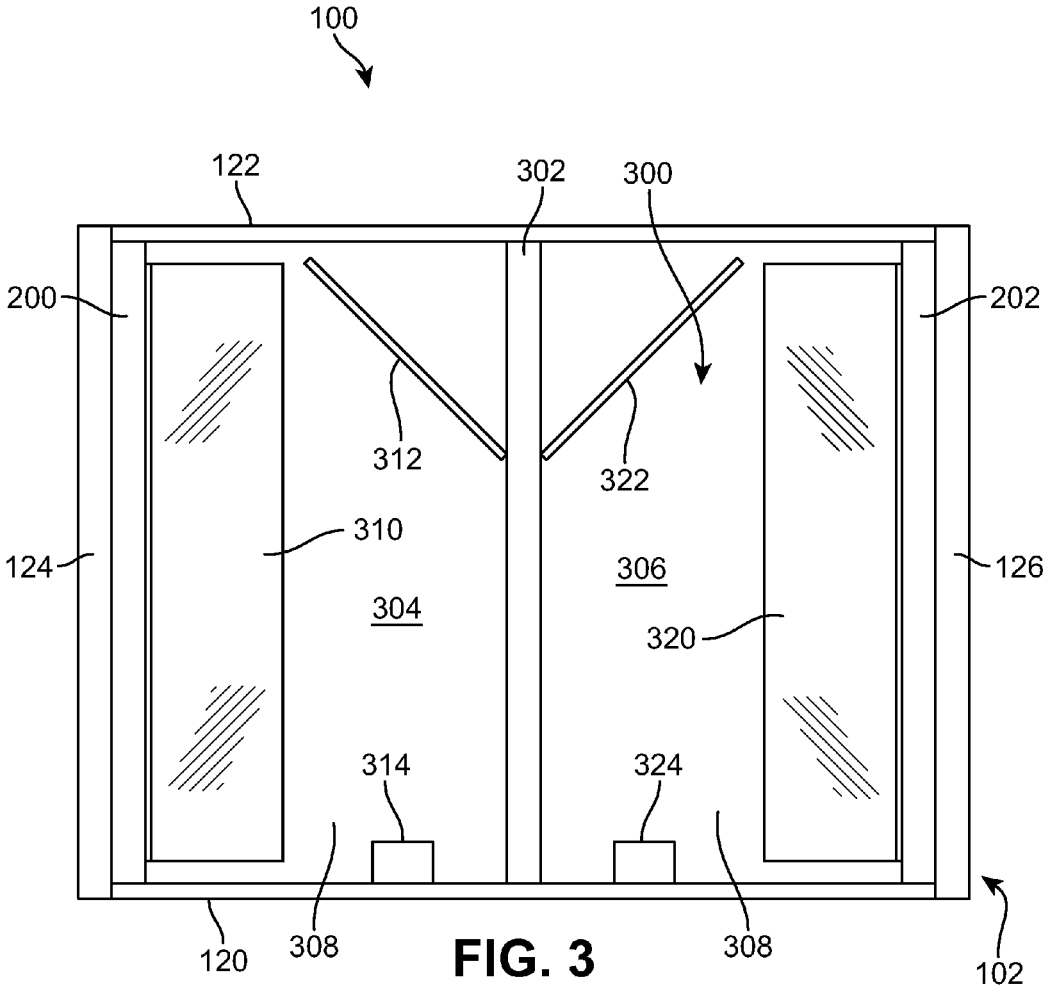
FIG. 3 is an interior view of an exemplary embodiment of a foot imaging and measurement apparatus.

Referring now to FIG. 3, an interior view of foot imaging and measurement apparatus 100 is illustrated. As illustrated in FIG. 3, plate 104 has been removed to allow a view into an interior 300 of housing 102. In some embodiments, interior 300 of housing 102 may include components configured to obtain images and/or measurements associated with a foot or feet of a user. Different embodiments of foot imaging and measurement apparatus 100 may include different components. Any of the following components associated with foot imaging and measurement apparatus 100 may be considered optional in some embodiments. Some embodiments may include a given component, while others may exclude it. The following description discloses many of the possible components that may be used with foot imaging and measurement apparatus 100, however, it should be kept in mind that not every component must be used in a given embodiment. In an exemplary embodiment, components disposed within interior 300 of housing 102 may be provided separately on either side of a divider 302 to be associated with a right and left foot of a user.

In some embodiments, one or more compact mirror assembly arrangements may be used to reflect images of a user's foot from above top surface 106 towards one or more cameras. In one embodiment, a first side compact mirror assembly 304 may be provided on the first side of interior 300 of housing 102 to obtain images and/or measurements of a right foot of a user. Similarly, a second side compact mirror assembly 306 may be provided on the second side of interior 300 of housing 102 to obtain images and/or measurements of a left foot of a user.

In some embodiments, components within interior 300 of housing 102 may be disposed along a bottom surface 308 of housing 102. In some cases, components may be fixed in place along bottom surface 308. In other cases, one or more components may be removably placed along bottom surface 308 such that individual components may be removed or adjusted within interior 300. In an exemplary embodiment, compact mirror assemblies are configured to be disposed along bottom surface 308 on each of the first side and the second side of housing 102 such that images of a user's foot from above top surface 106 are reflected by a plurality of mirrors towards one or more cameras.

In an exemplary embodiment, each of first side compact mirror assembly 304 and second side compact mirror assembly 306 may include several components configured to obtain images and/or measurements of a user's foot. In one embodiment, first side compact mirror assembly 304 may include a first top-facing mirror 310 disposed along the first side of interior 300 of housing 102.

In this embodiment, first top-facing mirror 310 is disposed along the longitudinal direction of housing 102 adjacent to first side ledge 200 and first side panel 124. First top-facing mirror 310 is configured to be tilted at an angle with respect to bottom surface 308 towards first side ledge 200 and first side panel 124. In some cases, first top-facing mirror 310 may have a length that is a substantial majority of the length of first side panel 124. In other cases, first top-facing mirror 310 may have a length that is shorter than the length of first side panel 124. With this arrangement, first top-facing mirror 310 may be configured to fit within interior 300 of housing 102 in the longitudinal direction.

In one embodiment, first side compact mirror assembly 304 may further include a first angled mirror 312 disposed to the right of first top-facing mirror 310 and along the first side of divider 302 within interior 300 of housing 102. In this embodiment, first angled mirror 312 is disposed at an angle to the lateral direction of housing 102 and is approximately perpendicular to bottom surface 308 along the vertical direction. First angled mirror 312 may be configured with one end adjacent to rear panel 122 and another end adjacent to divider 302. In some cases, first angled mirror 312 may have a length that is smaller than the length of rear panel 122 between first side panel 124 and divider 302. In other cases, first angled mirror 312 may have a length that is approximately the same as the length of rear panel 122 between first side panel 124 and divider 302. In addition, first angled mirror 312 may have a length that is substantially smaller than the length of first top-facing mirror 310. With this arrangement, first angled mirror 312 may be configured to fit within interior 300 of housing 102 in the lateral direction.

In some embodiments, first side compact mirror assembly 304 may further include a first camera 314. In an exemplary embodiment, first camera 314 may be configured to obtain images and/or measurements of a right foot of a user that have been reflected from top surface 106 by first top-facing mirror 310 and first angled mirror 312. First camera 314 may be any kind of camera capable of obtaining images and/or video information, including, but not limited to a CCD sensor, a digital still image camera, a video camera, or any other type of camera. In some cases, first camera 314 may obtain one or more still images. In other cases, first camera 314 may record video. In some embodiments, additional processing and/or computing devices may be integrated together with first camera 314 for processing or analyzing the images obtained of a user's foot to generate measurement data. In other embodiments, a central computer or processing unit may be included with the components of foot imaging and measurement apparatus 100 to process or analyze obtained images to generate measurement data. In still other embodiments, a computer or processing unit that is physically separate from foot imaging and measurement apparatus 100 may be configured to obtain images from first camera 314 via known wired or wireless mechanisms for further processing and/or analysis to generate measurement data.

In an exemplary embodiment, second side compact mirror assembly 306 may have a similar configuration as first side compact mirror assembly 304. In this embodiment, the components of second side compact mirror assembly 306 are arranged in a similar manner on the second side of divider 302 such that second side compact mirror assembly 306 is a mirror image of first side compact mirror assembly 304. In particular, second side compact mirror assembly 306 may include a second top-facing mirror 320 disposed along the second side of interior 300 of housing 102.

In this embodiment, second top-facing mirror 320 is disposed along the longitudinal direction of housing 102 adjacent to second side ledge 202 and second side panel 126. Second top-facing mirror 320 is configured to be tilted at an angle with respect to bottom surface 308 towards second side ledge 202 and second side panel 126. In some cases, second top-facing mirror 320 may have a length that is a substantial majority of the length of second side panel 126. In other cases, second top-facing mirror 320 may have a length that is shorter than the length of second side panel 126. In an exemplary embodiment, second top-facing mirror 320 may have a length that is substantially identical to the length of first top-facing mirror 310. With this arrangement, second top-facing mirror 320 may be configured to fit within interior 300 of housing 102 in the longitudinal direction.

In one embodiment, second side compact mirror assembly 306 may further include a second angled mirror 322 disposed to the left of second top-facing mirror 320 and along the second side of divider 302 within interior 300 of housing 102. In this embodiment, second angled mirror 322 is disposed at an angle to the lateral direction of housing 102 and is approximately perpendicular to bottom surface 308 along the vertical direction. Second angled mirror 322 may be configured with one end adjacent to rear panel 122 and another end adjacent to divider 302. In some cases, second angled mirror 322 may have a length that is smaller than the length of rear panel 122 between second side panel 126 and divider 302. In other cases, second angled mirror 322 may have a length that is approximately the same as the length of rear panel 122 between second side panel 126 and divider 302. In addition, second angled mirror 322 may have a length that is substantially smaller than the length of second top-facing mirror 320. In an exemplary embodiment, second angled mirror 322 may have a length that is substantially identical to the length of first angled mirror 312. With this arrangement, second angled mirror 322 may be configured to fit within interior 300 of housing 102 in the lateral direction.

In some embodiments, second side compact mirror assembly 306 may further include a second camera 324. In an exemplary embodiment, second camera 324 may be configured to obtain images and/or measurements of a left foot of a user that have been reflected from top surface 106 by second top-facing mirror 320 and second angled mirror 322. Second camera 324 may be any kind of camera capable of obtaining images and/or video information, including any camera described above in regard to first camera 314. As with first camera 314, in some embodiments, additional processing and/or computing devices may be integrated together with second camera 324 for processing or analyzing the images obtained of a user's foot to generate measurement data, while in other embodiments, a central computer or processing unit may be included with the components of foot imaging and measurement apparatus 100 to process or analyze obtained images to generate measurement data. In still other embodiments, a computer or processing unit that is physically separate from foot imaging and measurement apparatus 100 may be configured to obtain images from second camera 324 via known wired or wireless mechanisms for further processing and/or analysis to generate measurement data.

While the present embodiment has been described as having two cameras, one on each of the first side and the second side, for obtaining images and/or measurements of a foot or feet of a user, in other embodiments, a larger or smaller number of cameras may be used. In one embodiment, a single camera may be configured to obtain images of both a right and a left foot of a user. In still other embodiments, multiple cameras may be disposed on either side of interior 300 of housing 102 to obtain multiple images and/or views of each foot of a user.

In addition to the components shown in FIG. 3 and described above, it should be understood that each of first side compact mirror assembly 304 and/or second side compact mirror assembly 306 may further include additional components known in the art, including wired and wireless mechanisms, to connect first camera 314 and/or second camera 324 to one or more of a power source, a computer or CPU, and a communications port to transfer the images obtained by first camera 314 and/or second camera 324 to additional components and/or systems, as further described below.

Figure 4:
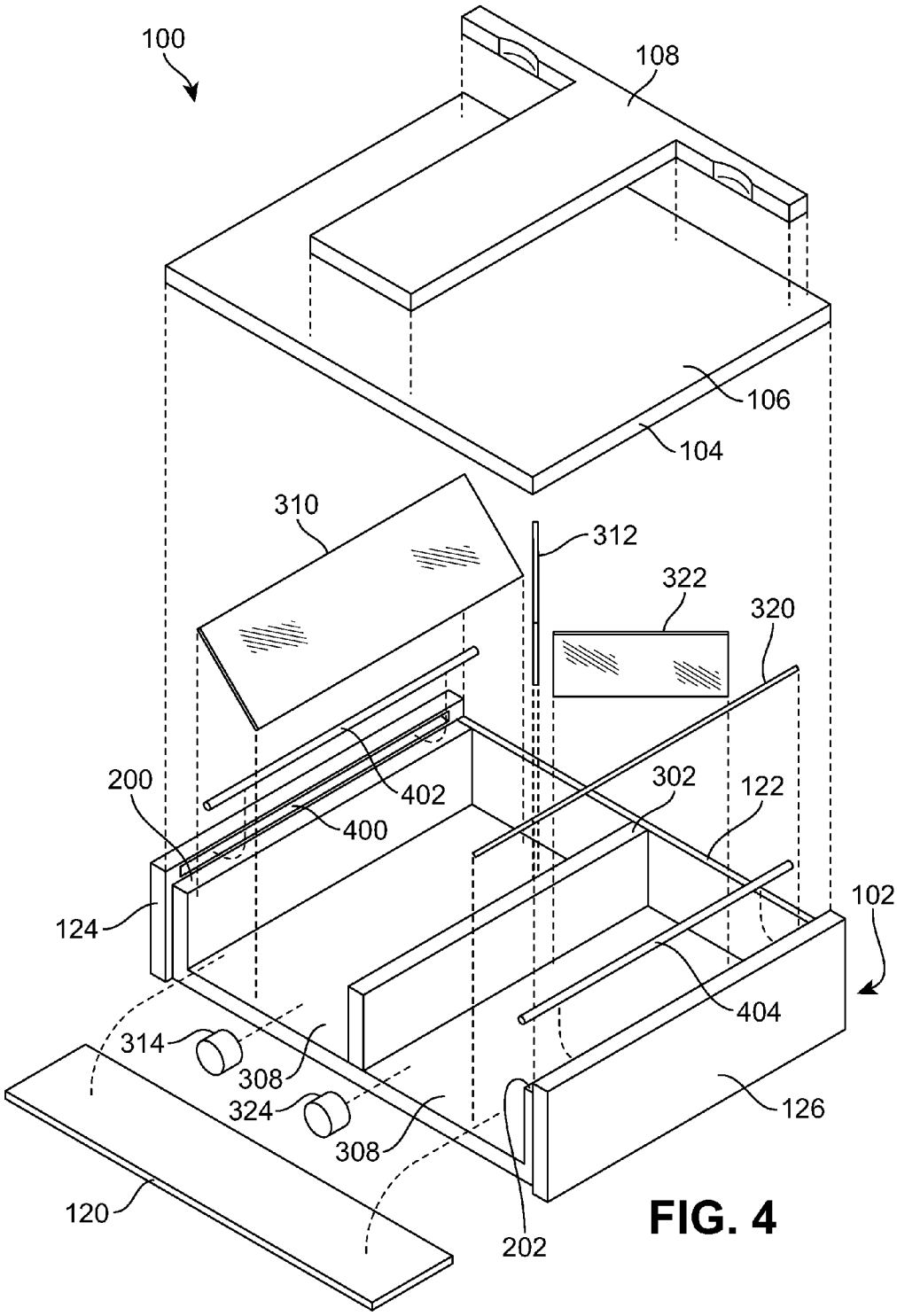
FIG. 4 is an exploded view of an exemplary embodiment of a foot imaging and measurement apparatus.

Referring now to FIG. 4, an exploded view of foot imaging and measurement apparatus 100 is illustrated. In this embodiment, the various components associated with foot imaging and measurement apparatus 100 are shown in an exploded schematic representation. It should be understood that additional components may be present that are configured to hold one or more of the illustrated components in place, including, but not limited to brackets, screws, nails, adhesives, fasteners, and other various types of attachment mechanisms. In addition, other known components may be present to provide power and/or communication capabilities, including, but not limited to communication and power cables, cords, and other known wired or wireless communication mechanisms.

In some embodiments, the various components described above may be assembled to provide a foot imaging and measurement apparatus 100 that is compact and readily portable. With this arrangement, foot imaging and measurement apparatus 100 may be moved to various locations to obtain images and/or measurements of the feet of multiple users. As shown in FIG. 4, in this embodiment, foot imaging and measurement apparatus 100 includes foot guide 108 that is associated with top surface 106 of plate 104. In some embodiments, foot guide 108 may be fixed or removable attached to top surface 106, while in other embodiments, foot guide 108 may be configured to rest upon top surface 106 of plate 104.

Plate 104 is configured to fit onto housing 102. Housing 102 includes a first side ledge 200 and a second side ledge 202 that provides support beneath plate 104. Interior 300 of housing 102 contains multiple components that are configured to obtain images and/or measurements of a user's feet, as described above. As shown in FIG. 4, a compact mirror assembly arrangement, including first compact mirror assembly 304 and second compact mirror assembly 306, described above, are configured to fit within interior 300 of housing 102 on either side of divider 302. First top-facing mirror 310 and second top-facing mirror 320 are disposed along the first and second sides of housing along the longitudinal direction and are titled with respect to bottom surface 308 of housing 102 so as to reflect an image of a foot above.

Each of first angled mirror 312 and second angled mirror 322 are disposed within interior 300 of housing 102 at an angle facing towards, respectively, first top-facing mirror 310 and second top-facing mirror 320 so as to reflect the image from each mirror towards a camera at the front end of housing 102 adjacent to front panel 120. As shown in this embodiment, first angled mirror 312 reflects the image from first top-facing mirror 310 towards first camera 314 and second angled mirror 322 reflects the image from second top-facing mirror 320 towards second camera 324.

In some embodiments, foot imaging and measurement apparatus 100 may include one or more light sources to provide lighting for first camera 314 and/or second camera 316. In an exemplary embodiment, light sources may be provided within one or more recesses associated with side panels of housing 102. In this embodiment, a first recess 400 is provided within first side panel 124. In some cases, first recess 400 may be disposed along substantially the entire length of first side panel 124. In other cases, first recess 400 may extend less than the entirety of first side panel 124. In one embodiment, first recess 400 may be provided at a depth from the top of first side panel 124 so that a light source disposed within first recess 400 is aligned with a side edge of plate 104. With this arrangement, a light source may provide edge lighting to plate 104. In this embodiment, a second recess (not illustrated) is provided within second side panel 126 in a substantially similar manner as first recess 400 so as to provide a space for a light source on the second side of housing 102.

In an exemplary embodiment, a first side light source 402 may be disposed within first recess 400 within first side panel 124 to provide lighting for first camera 314 and a second side light source 404 may be disposed within the second recess within second side panel 126 to provide lighting for second camera 324. In one embodiment, first side light source 402 and/or second side light source 404 may include one or more arrays of LED lighting elements. In other embodiments, first side light source 402 and/or second side light source 404 may include any known kind of lighting device. With this arrangement, first camera 314 and/or second camera 324 may be provided with sufficient lighting to obtain images and/or measurements of the feet of a user. In addition, in embodiments where first recess 400 and the second recess are provided at depths that coincide with the edge of plate 104, first side light source 402 and/or second side light source 404 may provide edge-lighting to plate 104 to assist with illuminating portions of user's foot that are in contact with top surface 106 of plate 104, as further described with reference to FIG. 8 below.

Figure 5:
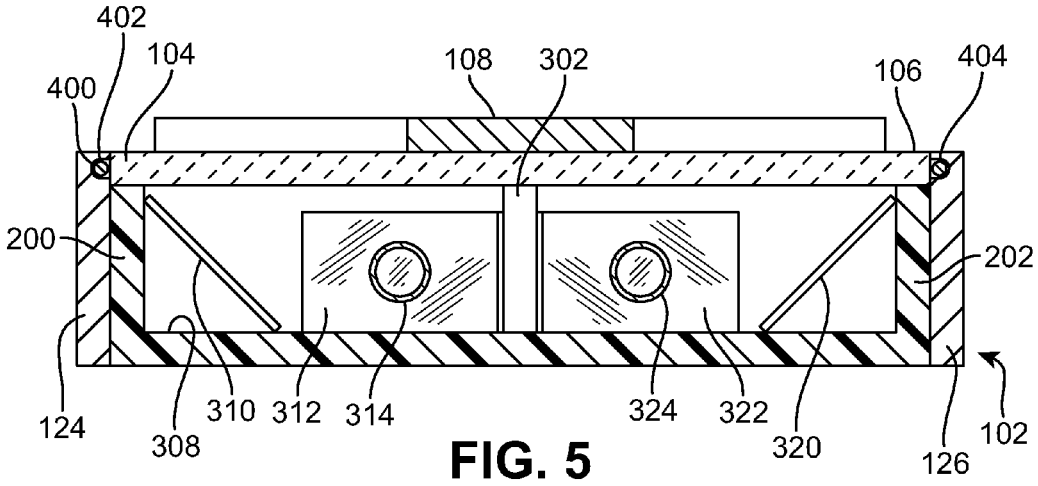
FIG. 5 is a lateral cross-sectional view illustrating an interior of an exemplary embodiment of a foot imaging and measurement apparatus as seen from the front.
Figure 6:
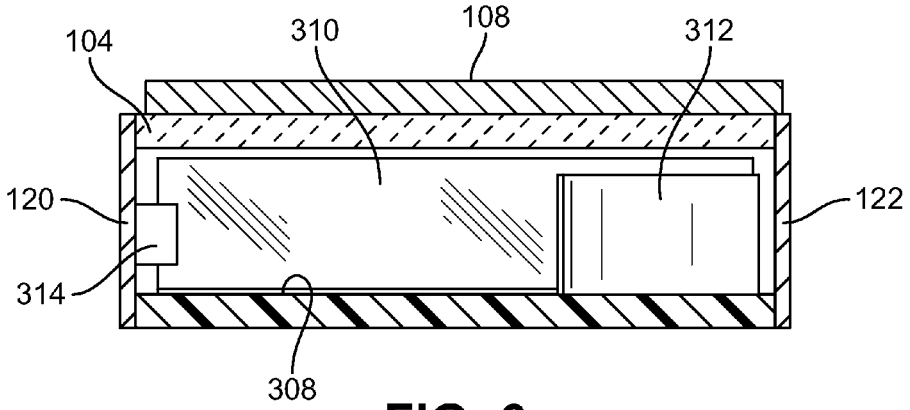
FIG. 6 is a longitudinal cross-sectional view illustrating an interior of an exemplary embodiment of a foot imaging and measurement apparatus as seen from the side.

Referring now to FIGS. 5 and 6, cross-sectional views of foot imaging and measurement apparatus 100 to show interior 300 of housing 102 across a lateral direction (FIG. 5) and across a longitudinal direction (FIG. 6) are illustrated. FIG. 5 illustrates a lateral cross-sectional view of interior 300 of foot imaging and measurement apparatus 100 as seen from the front end. In some embodiments, the arrangement of the compact mirror assemblies within housing 102 may be configured so that components are aligned along substantially the same plane.

In an exemplary embodiment, first compact mirror assembly 304 includes first top-facing mirror 310, first angled mirror 312 and first camera 314 that are disposed along a substantially similar horizontal plane. In this embodiment, first top-facing mirror 310 is disposed along bottom surface 308 of housing 102 at an angle such that the top edge is adjacent to first side panel 124 and first side ledge 200. In an exemplary embodiment, first top-facing mirror 310 may be at approximately a 45 degree angle with respect to bottom surface 308. As shown in FIG. 5, each of first angled mirror 312 and first camera 314 are similarly aligned along substantially the same horizontal plane as first top-facing mirror 310 so that the middle of first top-facing mirror 310 is approximately level with the middle of first angled mirror 312 and the center of first camera 314. With this arrangement, first compact mirror assembly 304 may be provided to obtain images and/or measurements of a right foot of user from top surface 106 above.

In some embodiments, second compact mirror assembly 306 may have a substantially similar arrangement as first compact mirror assembly 304 disposed on the opposite side of divider 302. In an exemplary embodiment, second compact mirror assembly 306 includes second top-facing mirror 320, second angled mirror 322 and second camera 324 that are disposed along a substantially similar horizontal plane. In this embodiment, second top-facing mirror 320 is disposed along bottom surface 308 of housing 102 at an angle such that the top edge is adjacent to second side panel 126 and second side ledge 202. In an exemplary embodiment, second top-facing mirror 320 may be at approximately a 45 degree angle with respect to bottom surface 308. As shown in FIG. 5, each of second angled mirror 322 and second camera 324 are similarly aligned along substantially the same horizontal plane as second top-facing mirror 320 so that the middle of second top-facing mirror 320 is approximately level with the middle of second angled mirror 322 and the center of second camera 324. With this arrangement, second compact mirror assembly 306 may be provided to obtain images and/or measurements of a left foot of user from top surface 106 above.

In an exemplary embodiment, first side light source 402 and/or second side light source 404 may be provided on either side of housing 102 to provide lighting to interior 300 and/or plate 104, as described above. As shown in FIG. 5, first recess 400 is disposed within first side panel 124 and is configured to receive first side light source 402. Similarly, a second recess is disposed with second side panel 126 and is configured to receive second side light source 404. In one embodiment, first recess 400 and/or the second recess may be provided at depths that allow first side light source 402 and/or second side light source 404 to be aligned with the edge to plate 104 and to provide edge-lighting to plate 104.

FIG. 6 illustrates a longitudinal cross-sectional view of interior 300 of foot imaging and measurement apparatus 100 as seen from the right side. In this embodiment, first compact mirror assembly 304 is shown from a side view. As described in regard to FIG. 5, above, each of first angled mirror 312 and first camera 314 are similarly aligned along substantially the same horizontal plane as first top-facing mirror 310 so that the middle of first top-facing mirror 310 is approximately level with the middle of first angled mirror 312 and the center of first camera 314. It should be understood that second compact mirror assembly 306 has a similar appearance as seen from the first side.

Figure 7:
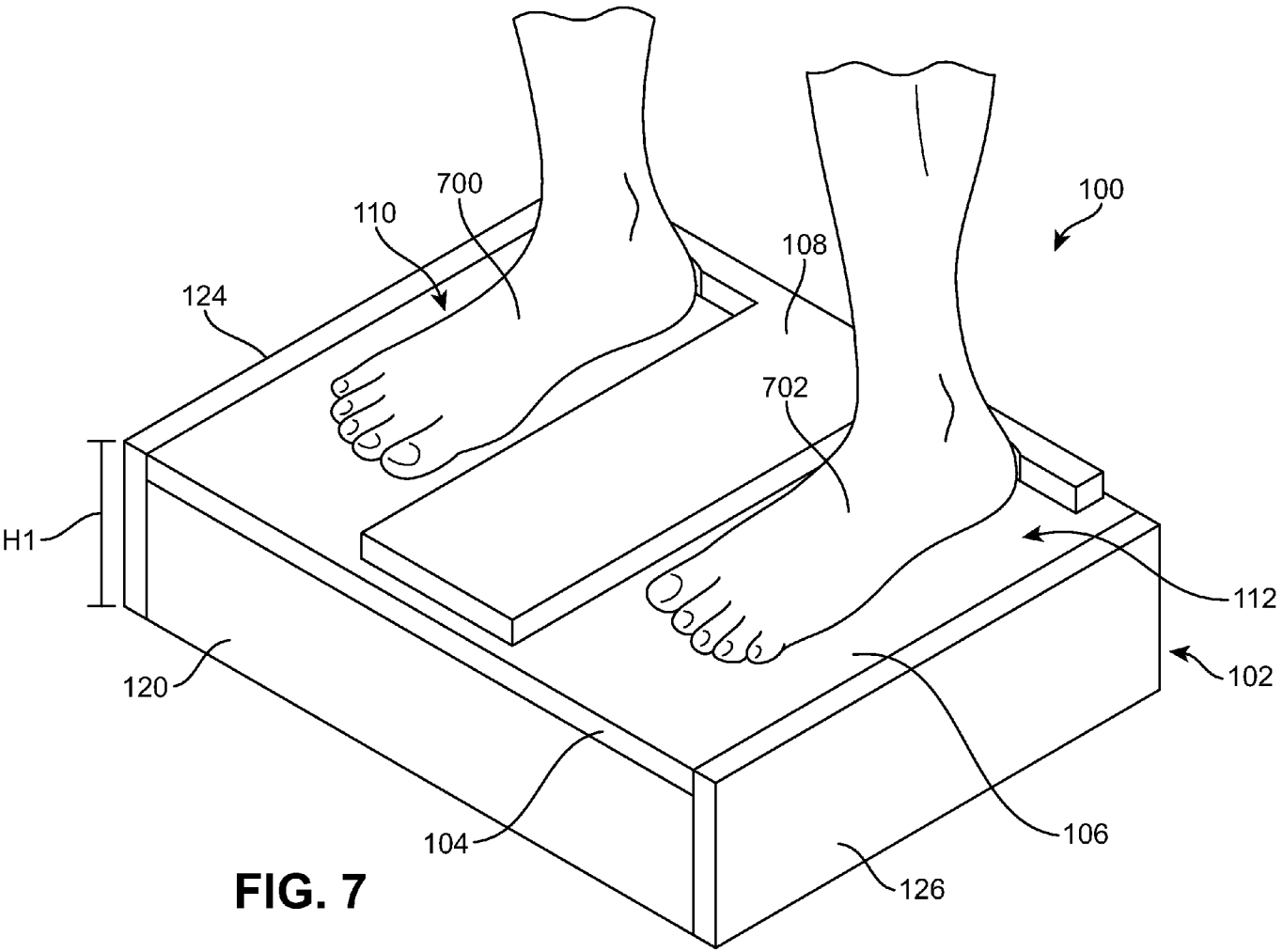
FIG. 7 is a representational view of feet disposed on a top surface of an exemplary embodiment of a foot imaging and measurement apparatus.

FIGS. 7 through 11 illustrate various representational and schematic views of images and/or measurements of a foot or feet of a user obtained using foot imaging and measurement apparatus 100. It should be understood that the Figures are for the purposes of illustration and are not to scale. Referring now to FIG. 7, a user is illustrated standing on top of foot imaging and measurement apparatus 100. In an exemplary embodiment, a user may stand on foot imaging and measurement apparatus 100 by placing his or her feet on top surface 106 of plate 104. In some embodiments, foot guide 108 may be provided on top surface 106 to assist a user with placement of the user's feet on either side of plate 104. In one embodiment, foot guide 108 may further include first recess 130 and/or second recess 132 that are configured to associate with the heels of a user's feet to assist with placement of his or her feet.

In an exemplary embodiment, a user may place a right foot 700 on first portion 110 of top surface 106 and a left foot 702 on second portion 112 of top surface 106 on either side of foot guide 108. In some embodiments, foot imaging and measurement apparatus 100 may be configured with a relatively compact form so that a user is able to easily and comfortably step on and off foot imaging and measurement apparatus 100. In an exemplary embodiment, foot imaging and measurement apparatus 100 is configured with a height H1 that is selected so that a user may easily and comfortably step on and off top surface 106 of plate 104. In one embodiment, height H1 may be approximately the average height of a raised foot when a person takes a step. In some cases, height H1 may be from 5 inches to 10 inches. In other cases, height H1 may be smaller or larger. With this arrangement, a user need not raise his or her feet to an uncomfortable level to step onto foot imaging and measurement apparatus 100.

Figure 8:
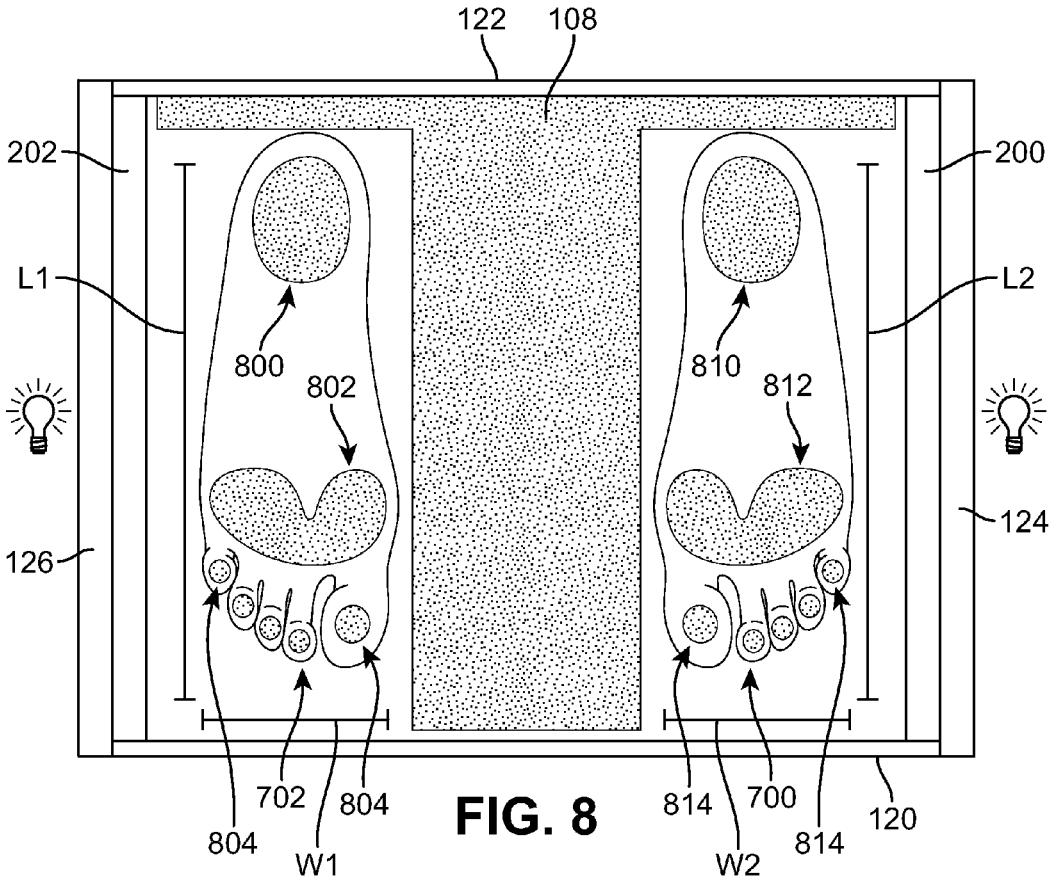
FIG. 8 is a representational view of an underside of a top surface of an exemplary embodiment of a foot imaging and measurement apparatus during illumination while feet are disposed on the top surface.

Referring now to FIG. 8, a representational view of an underside of top surface 106 of foot imaging and measurement apparatus 100 with a user standing on plate 104 is illustrated. In this embodiment, plate 104 is shown from underneath as viewed from within interior 300 of housing 102. In one embodiment, right foot 700 and left foot 702 of a user may be disposed on plate 104, as seen from below during illumination of first side light source 402 and/or second side light source 404. In some embodiments, one or more cameras, including first camera 314 and/or second camera 324, may be configured to obtain images and/or measurements of right foot 700 and/or left foot 702.

In an exemplary embodiment, foot measurement data may be obtained for each of right foot 700 and left foot 702. In one embodiment, a first length L1 and a first width W1 associated with left foot 702 may be obtained by second camera 324 and a second length L2 and a second width W2 associated with right foot 700 may be obtained by first camera 314. In some embodiments, a processing algorithm may be used to calculate first length L1, second length L2, first width W1, and/or second width W2 from images obtained from second camera 324. In other embodiments, plate 104 may be marked with one or more lines set a known distance apart to calculate first length L1, second length L2, first width W1, and/or second width W2. In still other embodiments, plate 104 may instead be marked with a known scale for measuring feet sizes, including, but not limited to the Brannock sizing scale or other known sizing scales.

In other embodiments, additional foot measurement data may be obtained for right foot 700 and/or left foot 702 from captured images, including, but not limited to: girth, heel length, heel width, arch length, arch width, toe length, ball width, and other measurements of a user's foot taken at various portions of the foot.

In an exemplary embodiment, one or more light sources, including first side light source 402 and/or second side light source 404, may provide edge-lighting to plate 104, as described above. In one embodiment, images of a user's feet may be obtained during edge-lit illumination of plate 104. During edge-lit illumination of plate 104, the portions of a user's feet that are in direct contact with plate 104 will be highlighted. In some cases, the portions of a user's feet that are in direct contact with plate 104 may appear brighter in correspondence to the pressure being applied. With this arrangement, a pressure map or contour image may be obtained of a user's foot or feet.

As shown in FIG. 8, portions of left foot 702 in direct contact with plate 104 are highlighted by edge-lighting of plate 104, including a heel portion 800, a ball portion 802, and toe portions 804. Similar portions of right foot 700 in direct contact with plate 104 are also highlighted by edge-lighting of plate 104, including a heel portion 810, a ball portion 812, and toe portions 814. In other embodiments, additional portions of right foot 700 and/or left foot 702 may be in contact with plate 104. In addition, in some embodiments, brightness of the portions of the foot may vary in correspondence with the pressure being applied. With this arrangement, a pressure map or contour image of a user's feet may be obtained by first camera 314 and/or second camera 324.

Figure 9:
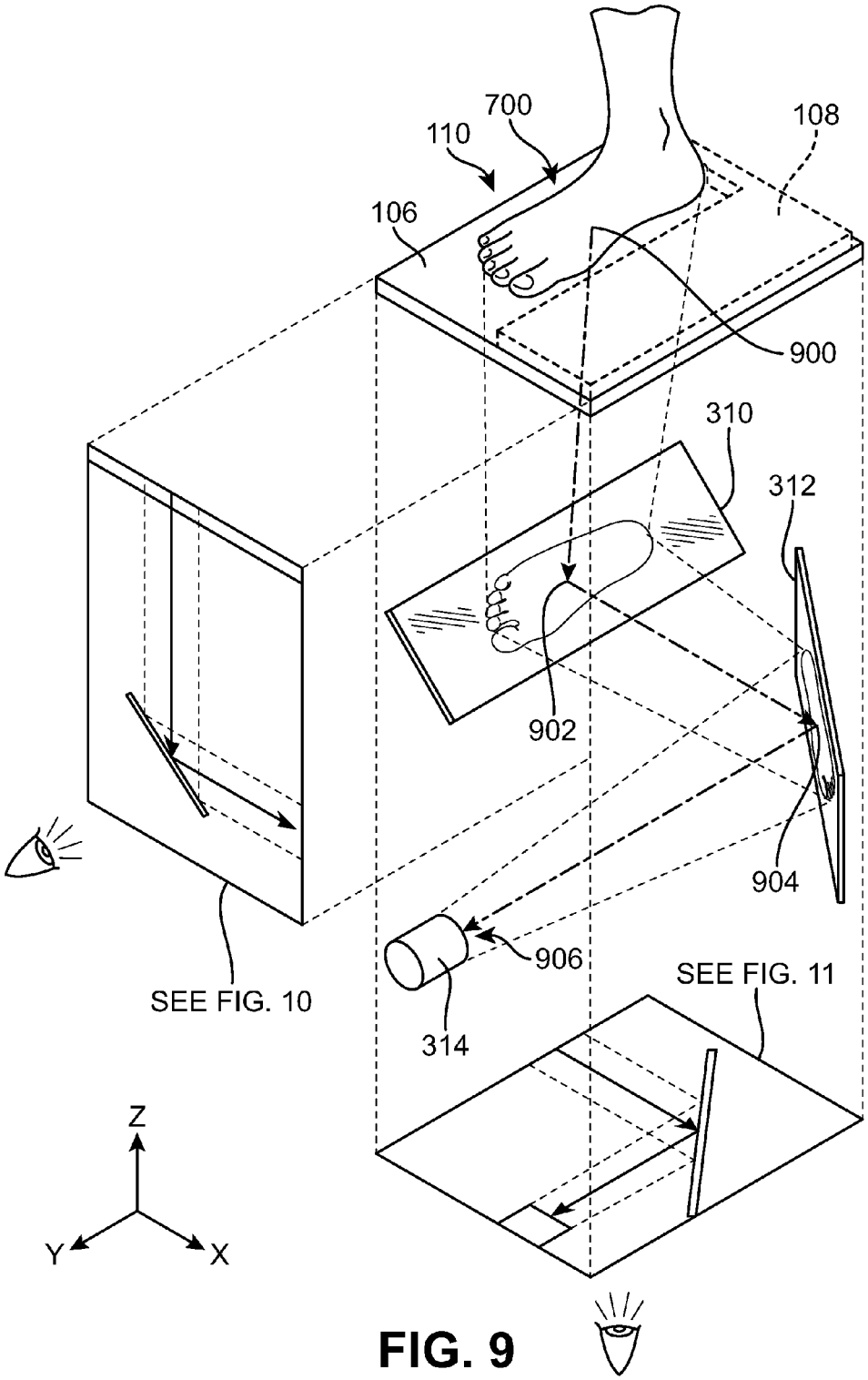
FIG. 9 is a schematic view of the imaging path within the interior of an exemplary embodiment of a foot imaging and measurement apparatus.
Figure 10:
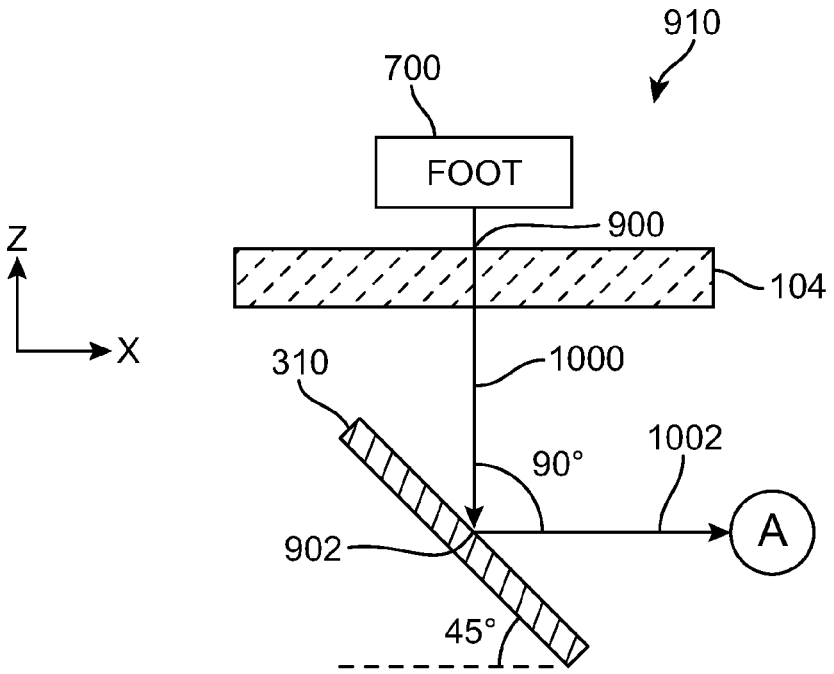
FIG. 10 is a schematic view of a partial imaging path along an z-x plane from a foot to a first reflecting mirror associated with a foot imaging and measurement apparatus.
Figure 11:
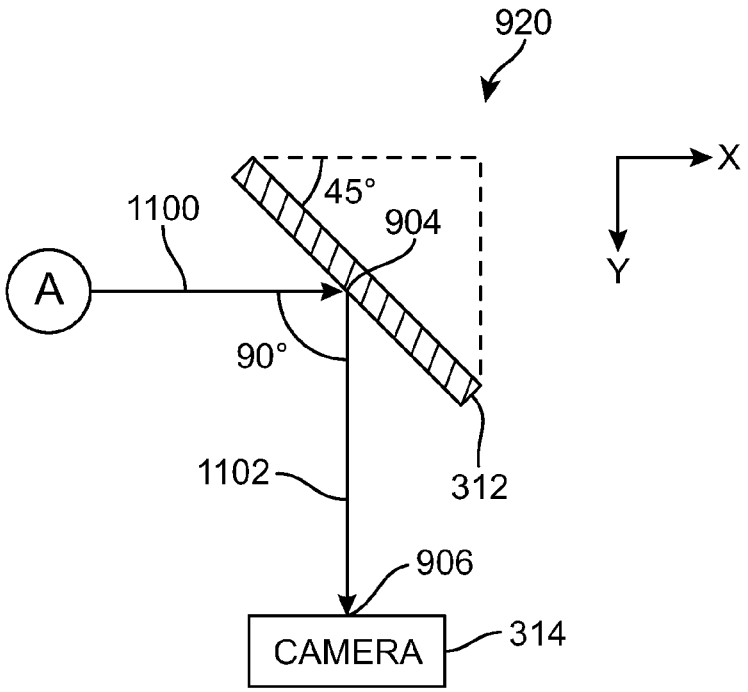
FIG. 11 is a schematic view of a partial imaging path along an x-y plane from a second reflecting mirror to a camera associated with a foot imaging and measurement apparatus.

FIGS. 9 through 11 illustrate a schematic view of the reflection of images from top surface 106 of foot imaging and measurement apparatus 100 to a camera using a plurality of mirrors to reflect the image along different axes. It should be understood that the image may be represented as a plane defined by two axes that travels in the direction of the third axis. In the present embodiments, only right foot 700 of a user is illustrated for purposes of discussion, however, a substantially similar arrangement may be provided for left foot 702 of a user. It should be understood that the Figures are for illustrative purposes only and are not intended to provide an accurate rendering that is to scale.

Referring now to FIG. 9, right foot 700 of a user is disposed on first side portion 110 of top surface 106. In an exemplary embodiment, an image of the underside of right foot 700 travels in the vertical direction approximately along the z-axis from a first point 900 on top surface 106 towards a second point 902 disposed on a surface of first top-facing mirror 310. In an exemplary embodiment, first top-facing mirror 310 is disposed at approximately a 45 degree angle from the z-axis. Proceeding from second point 902, first top-facing mirror 310 reflects the image of right foot 700 by approximately 90 degrees so that the image travels in the lateral direction approximately along the x-axis towards a third point 904 disposed on a surface of first angled mirror 312. In an exemplary embodiment, first angled mirror 312 is disposed at approximately a 45 degree angle from the x-axis. Proceeding from third point 904, first angled mirror 312 reflects the image of right foot 700 by approximately 90 degrees so that the image travels in the longitudinal direction approximately along the y-axis towards a lens 906 of first camera 314.

With this arrangement, first compact mirror assembly 304, including first top-facing mirror 310 and first angled mirror 312, may reflect the image of right foot 700 across multiple axes towards first camera 314. As shown in FIG. 9, line-of-sight ray tracings illustrate the transition of image of right foot 700 from the vertical direction to the lateral direction (FIG. 10), and from the lateral direction to the longitudinal direction (FIG. 11), as it travels towards first camera 314.

Referring now to FIG. 10, a schematic view of a first line-of-sight ray tracing 910 illustrates the transition of image of right foot 700 from the vertical direction to the lateral direction. In this embodiment, right foot 700 is disposed on or above plate 104. The image of right foot 700 travels from first point 900 through plate 104 towards first top-facing mirror 310 along a first path 1000. As discussed above, first top-facing mirror 310 may be disposed at approximately a 45 degree angle from the z-axis. In some cases, first top-facing mirror 310 may be disposed slightly more or less than 45 degrees to permit adjustment of alignment of mirrors within foot imaging and measurement apparatus 100. The image of right foot 700 is reflected off the surface of first top-facing mirror 310 at second point 902 by an angle of approximately 90 degrees so that the image travels in the lateral direction approximately along the x-axis along a second path 1002. The image of right foot 700 then travels in the lateral direction towards first angled mirror 312, as illustrated in FIG. 11, below.

Referring now to FIG. 11, a schematic view of a second line-of-sight ray tracing 920 illustrates the transition of image of right foot 700 from the lateral direction to the longitudinal direction. In this embodiment, the image of right foot 700 continues in the lateral direction approximately along the x-axis from first top-facing mirror 310, as illustrated in FIG. 10, above. The image of right foot 700 travels towards first angled mirror 312 along a third path 1100. As discussed above, first angled mirror 312 may be disposed at approximately a 45 degree angle from the x-axis. In some cases, first angled mirror 312 may be disposed slightly more or less than 45 degrees to permit adjustment of alignment of mirrors within foot imaging and measurement apparatus 100. The image of right foot 700 is reflected off the surface of first angled mirror 312 at third point 904 by an angle of approximately 90 degrees so that the image travels in the longitudinal direction approximately along the y-axis along a fourth path 1102. The image of right foot 700 then continues to travel in the longitudinal direction along fourth path 1102 towards first camera 314, where it is captured by lens 906.

Figure 12:
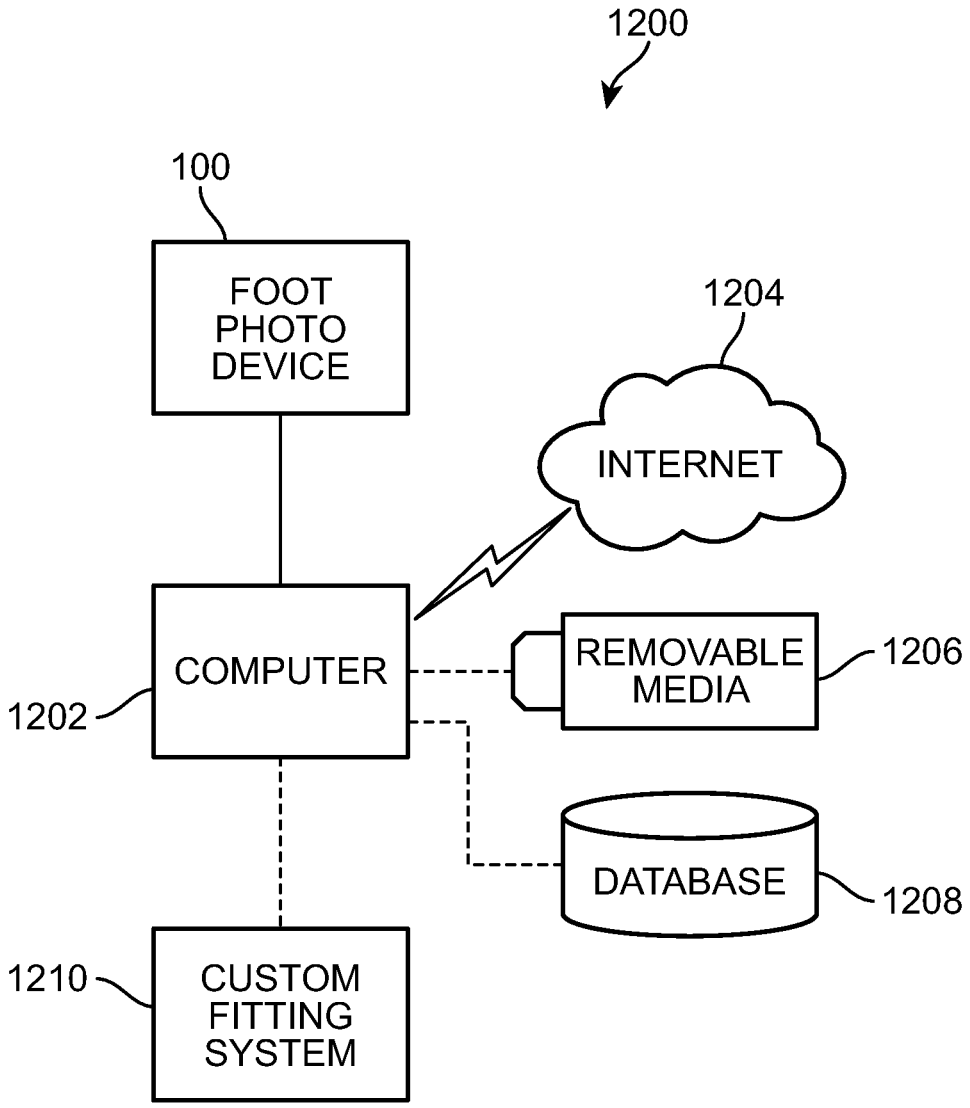
FIG. 12 is a schematic view of an exemplary embodiment of a system for using information from a foot imaging and measurement apparatus.

With all of the components described above, in some embodiments, a system for using images and/or measurements of a foot or feet of a user obtained from foot imaging and measurement apparatus 100 may be provided. Referring now to FIG. 12, an exemplary embodiment of a system 1200 may include one or more uses of images and/or measurements obtained from foot imaging and measurement apparatus (foot photo device) 100. In one embodiment, a separate computer 1202 may be coupled to the necessary components of system 1200 and may be configured to perform various processing, calculating, and storing operations: In other embodiments, one or more of the various operations may be performed using a computer or processor that is included with foot imaging and measurement apparatus 100, described above.

In an exemplary embodiment, computer 1202 may be configured to store images and/or measurement data obtained by foot imaging and measurement apparatus 100. In some embodiments, images and/or measurement data for a user may be tagged for the particular user by an identifier and stored in one or more locations, including, but not limited to a remote location over the internet 1204, removable media 1206, and/or a database 1208. The identifier and measurement data may also be stored at any one or more of the remote location over the internet 1204, removable media 1206, and/or a database 1208, so that repeated purchases by the same user may be prepared by employing the stored measurement data instead of having to take the measurements again. Commonly assigned U.S. patent application Ser. No. 10/675,237 filed on Sep. 30, 2003, now Publication No. 2005/0071242, published on Mar. 31, 2005, describes a Method and System for Custom Manufacturing Footwear which employs such a database in the network, and is hereby incorporated by reference in its entirety. The method and system described in this prior application may be adapted for use with the foot imaging and measurement apparatus 100 of the present application.

In some embodiments, computer 1202 may be configured to process the images and/or measurement data from foot imaging and measurement apparatus 100 to calculate a shoe size or customized measurements for the feet of a wearer. In some cases, these functions may be programmed into an included computer or processor of foot imaging and measurement apparatus 100, described above, or any other component of system 1200. In addition, in other embodiments, calculated results may be displayed to a user or other persons via a display (not shown).

In some embodiments, system 1200 may use images and/or measurements of the foot or feet of a user for custom fitting shoes. In an exemplary embodiment, a custom fitting system 1210 may use images and/or measurement data from foot imaging and measurement apparatus 100 and/or calculated sizes or measurements from computer 1202 to create custom-fitted shoes or footwear for a user. In one embodiment, custom fitting system 1210 may be the custom fitting system described in one or more of commonly assigned U.S. Ser. No. 11/202,657, filed on Aug. 12, 2005, now U.S. Pat. No. 7,287,293, entitled "Custom Fit System With Adjustable Last And Method For Custom Fitting Athletic Shoes," U.S. Ser. No. 11/867,007, filed on Oct. 4, 2007, now U.S. Pat. No. 7,757,325, entitled "Custom Fit System And Method For Custom Fitting Athletic Shoes," U.S. Ser. No. 12/837,955, filed on Jul. 16, 2010, now U.S. Pat. No. 7,980,007, entitled "Custom Fit System And Method For Custom Fitting Athletic Shoes," and U.S. Ser. No. 12/838,965, filed on Jul. 19, 2010, now U.S. Pat. No. 7,992,243, entitled "Custom Fit System With Adjustable Last And Method For Custom Fitting Athletic Shoes," the disclosures of all of which applications are hereby incorporated by reference in their entireties. The method and system of providing custom fitted article of footwear described in these prior applications may be adapted for use with the foot imaging and measurement apparatus 100 of the present application.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A foot imaging and measurement apparatus comprising:

a plate having a top surface, the top surface configured to receive at least one foot of a user;

a housing, the housing configured to receive the plate;

a compact mirror assembly disposed within an interior of the housing, the compact mirror assembly including:

a first mirror disposed along a longitudinal direction of the housing, the first mirror oriented at a first angle from a bottom surface of the housing such that the first mirror is facing towards the plate;

a second mirror disposed along a lateral direction of the housing, the second mirror being substantially perpendicular to the bottom surface of the housing and oriented at a second angle from a rear panel of the housing such that the second mirror is facing towards the first mirror;

a camera disposed within the interior of the housing adjacent to a front panel of the housing, wherein the camera is facing towards the second mirror; and wherein an image of the at least one foot of a user is reflected by the first mirror to the second mirror in a first direction and the image is reflected by the second mirror to the camera in a second direction.

2. The foot imaging and measurement apparatus according to claim 1, wherein the first angle is approximately 45 degrees.

3. The foot imaging and measurement apparatus according to claim 2, wherein the second angle is approximately 45 degrees.

4. The foot imaging and measurement apparatus according to claim 1, wherein the camera is configured to obtain images of the at least one foot of user.

5. The foot imaging and measurement apparatus according to claim 4, wherein the image of the at least one foot of a user is reflected by the first mirror in the first direction by approximately 90 degrees from the vertical direction to the lateral direction.

6. The foot imaging and measurement apparatus according to claim 5, wherein the image of the at least one foot of a user is reflected by the second mirror in the second direction by approximately 90 degrees from the lateral direction to the longitudinal direction.

7. A foot imaging and measurement apparatus comprising:

a plate having a top surface, the top surface configured to receive at least one foot of a user;

a housing having a rectangular shape, the housing comprising a front panel, a rear panel, a first side panel, a second side panel, and a bottom surface, the housing further configured to receive the plate at a top end;

the housing including an interior disposed below the plate;

a divider disposed along a longitudinal direction of the housing, the divider separating the interior into a second side and a first side;

a first compact mirror assembly disposed within the first side of the interior of the housing, the first compact mirror assembly including:

a first mirror disposed along the longitudinal direction of the housing, the first mirror oriented at a first angle from the bottom surface of the housing such that the first mirror is facing towards the plate, the first mirror reflecting an image of the foot laterally;

a second mirror disposed along a lateral direction of the housing, the second mirror being substantially perpendicular to the bottom surface of the housing and oriented at a second angle from the rear panel of the housing such that the second mirror is facing towards the first mirror, the second mirror reflecting the image of the foot longitudinally; and a first camera disposed within the first side of the interior of the housing adjacent to the front panel, wherein the first camera is facing towards the second mirror.

8. The foot imaging and measurement apparatus according to claim 7, wherein the plate comprises at least one of a transparent or semi-transparent material.

9. The foot imaging and measurement apparatus according to claim 7, the housing further comprising a first support ledge adjacent to the first side panel and a second support ledge adjacent to the second side panel; and wherein the first support ledge and the second support ledge are configured to provide support to the plate.

10. The foot imaging and measurement apparatus according to claim 9, wherein the first support ledge and the second support ledge are configured so that the plate sits flush with a top of the first side panel and a top of the second side panel.

11. The foot imaging and measurement apparatus according to claim 7, further comprising a foot guide disposed on the plate, the foot guide separating the top surface of the plate into a first portion configured to be associated with a right foot of a user and a second portion configured to be associated with a left foot of a user.

12. The foot imaging and measurement apparatus according to claim 7, further comprising:

a second compact mirror assembly disposed within the second side of the interior of the housing, the second compact mirror assembly including:

a third mirror disposed along the longitudinal direction of the housing, the third mirror oriented at the first angle from the bottom surface of the housing such that the third mirror is facing towards the plate;

a fourth mirror disposed along the lateral direction of the housing, the fourth mirror being substantially perpendicular to the bottom surface of the housing and oriented at the second angle from the rear panel of the housing such that the fourth mirror is facing towards the second mirror; and a second camera disposed within the second side of the interior of the housing adjacent to the front panel, wherein the second camera is facing towards the fourth mirror.

13. The foot imaging and measurement apparatus according to claim 12, wherein the first angle and the second angle are approximately 45 degrees.

14. The foot imaging and measurement apparatus according to claim 12, wherein the first compact mirror assembly is configured to reflect at least one image of a right foot of a user from the top surface of the plate to the first camera; and wherein the second compact mirror assembly is configured to reflect at least one image of a left foot of a user from the top surface of the plate to the second camera.

15. The foot imaging and measurement apparatus according to claim 12, further comprising a first recess disposed within at least one of the first side panel and the second side panel; and a light source disposed within the first recess, the light source configured to illuminate the plate.

16. The foot imaging and measurement apparatus according to claim 15, wherein the light source is configured to illuminate an edge of the plate; and wherein at least one of foot contour data and foot pressure data is obtained from the first camera or the second camera when the light source is illuminating the edge of the plate while at least one foot of a user is disposed on the plate.

17. A foot imaging and measurement apparatus, the foot imaging and measurement apparatus comprising:

a housing, the housing comprising a front panel, a first side panel, a second side panel, a rear panel, a divider and a bottom surface;

a plate, the plate disposed on a top end of the housing opposite the bottom surface of the housing;

the housing including an interior, the interior having a generally rectangular shape defined by the front panel, the first side panel, the second side panel, and the rear panel;

a camera disposed within the interior of the housing;

a compact mirror assembly disposed within the interior of the housing, the compact mirror assembly comprising:

a first mirror disposed along a longitudinal direction of the interior, adjacent to at least one of the first side panel and the second side panel, the first mirror disposed at approximately a 45 degree angle from the bottom surface such that a top end of the first mirror is adjacent to the plate and a bottom end is proximate the bottom surface, wherein an image is reflected by the first mirror towards the divider;

a second mirror disposed along a lateral direction of the interior, adjacent to the rear panel and disposed generally perpendicular to the bottom surface, the second mirror disposed at approximately a 45 degree angle from the rear panel in a direction towards the first mirror, wherein the image is reflected by the second mirror towards the camera; and wherein the first mirror, the second mirror, and the camera are disposed along the same horizontal plane within the interior of the housing.

18. The foot imaging and measurement apparatus according to claim 17, wherein the plate includes a top surface; and wherein the top surface is configured to receive at least one foot of a user.

19. The foot imaging and measurement apparatus according to claim 18, wherein the housing is configured to have a height from 5 inches to 10 inches.

20. The foot imaging and measurement apparatus according to claim 18, wherein the first mirror reflects an image of the at least one foot of a user on the top surface of the plate by an angle of approximately 90 degrees from a vertical direction to a lateral direction towards the second mirror; and wherein the second mirror reflects the image by an angle of approximately 90 degrees from the lateral direction to a longitudinal direction towards the camera.

* * * * *